US009200350B2

(12) United States Patent
Copponex et al.

(10) Patent No.: US 9,200,350 B2
(45) Date of Patent: Dec. 1, 2015

(54) SILVER ALLOY

(71) Applicant: JOHNSON MATTHEY PUBLIC LIMITED COMPANY, London (GB)

(72) Inventors: Thierry Copponex, La Chaux-de-Fonds (CH); Kang Ping Haung, La Chaux-de-Fonds (CH)

(73) Assignee: JOHNSON MATTHEY PUBLIC LIMITED COMPANY, London (GB)

( * ) Notice: Subject to any disclaimer, the term of this patent is extended or adjusted under 35 U.S.C. 154(b) by 0 days.

(21) Appl. No.: 14/352,386

(22) PCT Filed: Oct. 16, 2012

(86) PCT No.: PCT/GB2012/052557
§ 371 (c)(1),
(2) Date: Apr. 17, 2014

(87) PCT Pub. No.: WO2013/057480
PCT Pub. Date: Apr. 25, 2013

(65) Prior Publication Data

US 2014/0271340 A1 Sep. 18, 2014

(30) Foreign Application Priority Data

Oct. 17, 2011 (GB) ..... 1117877.9

(51) Int. Cl.
*C22C 5/06* (2006.01)
*C22C 1/02* (2006.01)

(52) U.S. Cl.
CPC .... *C22C 5/06* (2013.01); *C22C 1/02* (2013.01)

(58) Field of Classification Search
CPC ..... C22C 5/06
USPC ..... 420/503, 501, 505
See application file for complete search history.

(56) References Cited

U.S. PATENT DOCUMENTS

| | | | | |
|---|---|---|---|---|
| 6,506,267 | B1 * | 1/2003 | Fujiyasu et al. | 420/501 |
| 7,258,689 | B2 * | 8/2007 | Salvo | 606/41 |
| 7,413,618 | B2 * | 8/2008 | Obata et al. | 420/501 |
| 8,771,591 | B1 * | 7/2014 | Bennett | 420/503 |
| 2005/0220659 | A1 * | 10/2005 | Alan Robinson | 420/503 |
| 2007/0251610 | A1 * | 11/2007 | Johns | 148/559 |
| 2010/0239454 | A1 * | 9/2010 | Johns | 420/504 |

FOREIGN PATENT DOCUMENTS

| | | | |
|---|---|---|---|
| EP | 1 130 124 | A1 | 9/2001 |
| EP | 1 736 558 | A1 | 12/2006 |
| GB | 2 438 198 | A | 11/2007 |
| JP | 58 104146 | A | 6/1983 |
| JP | 6 100 6238 | A | 6/1984 |
| JP | 2 165895 | A | 6/1990 |
| JP | 2001/192753 | A | 7/2001 |
| JP | 2004/002929 | A | 1/2004 |
| JP | 2007023375 | A | 2/2007 |
| RU | 203320477 | C1 | 5/2008 |
| WO | 96/22400 | A1 | 7/1996 |
| WO | 2005/118903 | A1 | 12/2005 |

OTHER PUBLICATIONS

McGuire G E et al.: "Investigation of the Ag—In—Ge System Used for Alloyed Contacts to GaAs", Journal of Vacuum Science and Technology, New York, NY, US, vol. 16, No. 2, Mar. 1, 1979, pp. 141-144, XP001034184, ISSN: 0022-5355, DOI: 10.1116/1.569888 the whole document, Cited in ISR.
International Search Report, dated Nov. 28, 2012, from corresponding PCT application.
GB Search Report, dated Nov. 16, 2011, from corresponding GB application.

* cited by examiner

*Primary Examiner* — Helene Klemanski
(74) *Attorney, Agent, or Firm* — Young & Thompson

(57) ABSTRACT

A silver alloy with exceptional resistance to both tarnishing and firestain includes at least 92.50% silver, from 0.70 to 1.65% germanium, from 1.30 to 1.80% indium, from 0.000 to 0.015% boron, not more than 1.0% palladium and not more than 0.20% copper.

9 Claims, 4 Drawing Sheets

JMAg901 cast

After polishing

After metallographic attack

JMAg917 cast

After polishing

After metallographic attack

JMAg920 cast

After polishing

After metallographic attack

Precinox Ag925 cast

After polishing

After metallographic attack

SILVER ALLOY

FIELD OF THE INVENTION

This invention relates to a silver alloy with improved resistance to tarnishing and firestain.

BACKGROUND OF THE INVENTION

Silver is a noble metal that has many uses including in jewellery, decoration, coinage, cutlery, dentistry, medicine and electronics. For some of these applications, silver is too soft to be used in its pure state and it is typically alloyed with other metals such as copper to give a harder, more durable material. For example, sterling silver which is widely used in jewellery is 92.5% silver and 7.5% copper.

It is well known that under normal atmospheric conditions, silver and some silver alloys develop a dark sulphide-containing film known as tarnish on exposed surfaces. A specific problem of silver-copper alloys such as sterling silver is the development of dark staining when the alloy is annealed, brazed or soldered. These stains, which are known as firestain, are caused by oxidation of copper on and below the surface of the article which easily occurs in thermal processes. Firestain below the surface of the article cannot easily be removed by chemical or mechanical means. Firestain caused by soldering tends to be even more unsightly due to the high temperatures involved. Furthermore, if the depth of firestain exceeds more than about 0.025 mm, the alloy may be difficult to solder because it is difficult to remove the oxide by pickling and the oxidized surface will then not be properly wetted by the solder.

One solution to these problems is proposed in GB Patent No 2255348 which discloses a ternary alloy of silver in which part of the copper is replaced by germanium. It is claimed that this substantially reduces the occurrence of firestain and also reduces the development of tarnish during exposure to normal atmospheric conditions due to the formation of a thin layer of germanium oxide on exposed surfaces. A germanium content of 1.5 to 3.0% is preferred. Ternary silver alloys of this type have achieved commercial success and are sold under the trade mark ARGENTIUM®.

However, the present inventors have found that this solution does not eliminate the problem of firestain. Further, in applications where it is necessary to melt this alloy, it is found that a film forms on the surface making it difficult to estimate the temperature of the alloy visually as is conventionally done in this industry in order to control the casting process. There remains a need for a silver alloy with improved tarnish and firestain resistance.

SUMMARY OF THE INVENTION

The present inventors have surprisingly found that the elimination of copper and its replacement by a combination of indium and germanium with a limited palladium content produces a silver alloy with exceptional resistance to both tarnishing and firestain. Accordingly, the present invention provides a silver alloy comprising at least 92.50% silver, from 0.70 to 1.65% germanium, from 1.30 to 1.80% indium, from 0.000 to 0.015% boron, not more than 1.0% palladium and not more than 0.02% copper.

Without wishing to be bound by theory, the present inventors believe that it is likely that elements commonly used in silver alloys confer different benefits as regards resistance to tarnish and to firestain. In addition, some elements such as indium confer improved hardness but are less resistant to tarnish than silver itself.

DETAILED DESCRIPTION OF THE INVENTION

Figure 1A:
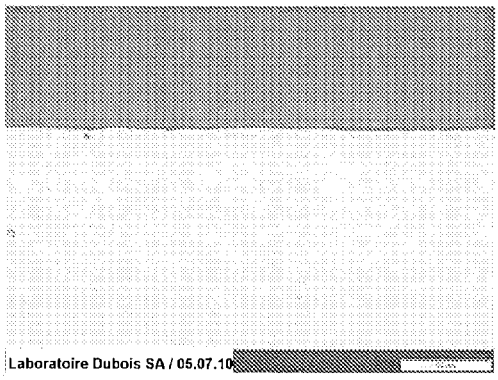
FIG. 1 shows a cross-section through specimens of alloys JM901, JM917, JM920 and Precinox® Ag925 before heat treatment and after metallographic attack.
Figure 1A:
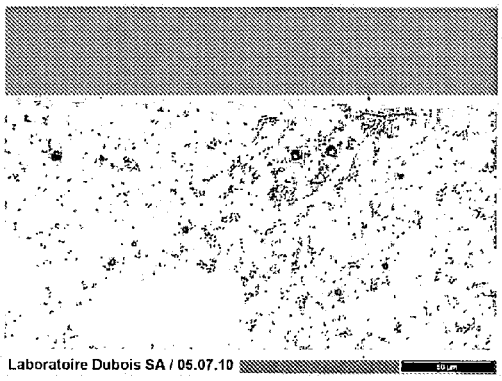

In this specification all percentages are by weight unless otherwise stated.

The minimum silver content of alloys according to the invention is 92.50%. Preferably, the minimum silver content is 95.00%, more preferably 97.00%.

The maximum germanium content of alloys according to the invention is restricted to 1.65%. In the present inventors' experience, the addition of germanium in amounts above this figure runs the risk of losing homogeneity of the alloy. Preferably, the germanium content is from 0.90 to 1.50%.

Alloys according to the invention may contain small amounts of boron up to 0.015% as a deoxidizing agent to improve castability. Preferably the boron content is from 10 to 100 ppm.

The indium content of alloys according to the invention is between 1.30 and 1.80%.

The maximum copper content permissible in alloys according to the invention is 0.02% i.e. 200 ppm but preferably, the copper content will be below 100 ppm and more preferably 50 ppm or below. Copper content may be measured by X-ray diffraction 15 or inductive coupled plasma techniques as known by those skilled in the art.

The maximum palladium content permissible in alloys according to the invention is 1.0%, but more preferably the palladium content is below 0.5%.

Based on our experimental results for tarnishing (according to ISO4538) and firestain (at 580° C. for 1 hr), preferably alloys according to the invention consist of silver, germanium, indium and optionally boron in the proportions stated above i.e. do not contain any other elements such as palladium, tin, gallium, zinc etc. in amounts above those that would normally be regarded as impurities.

Alloys according to the invention may be made by any suitable method known in the art. An example of a suitable method of preparation will now be given. 30 grams of germanium and 0.6 gram of boron were pre-alloyed by the flame of the arc and placed in a graphite crucible with 2916.00 grams of silver and 53.40 grams of indium. All these elements had a purity greater than 99.9%. The crucible was heated in a vacuum induction furnace under an atmosphere of argon. The molten alloy was then cast in a copper shell producing a 3000 gram ingot with dimensions 30×60×150 mm.

The invention will now be further described by reference to the following examples.

EXAMPLE 1

Three examples of the composition of alloys according to the invention are given below by way of illustration only.

| | Ag (wt %) | Ge (wt %) | In (wt %) | B (wt %) |
|---|---|---|---|---|
| JM901 | 97.20 | 1.00 | 1.80 | — |
| JM917 | 97.20 | 1.49 | 1.30 | 0.01 |
| JM920 | 97.20 | 1.00 | 1.80 | 0.01 |

EXAMPLE 2

In this example, the resistance to tarnishing of an alloy according to the invention is compared with those of seven other experimental alloys and three commercially available alloys. The compositions of the alloys are given below.

| | Ag (wt %) | Ge (wt %) | In (wt %) | Sn (wt %) | Ga (wt %) | Cu (wt %) | Zn (wt %) |
|---|---|---|---|---|---|---|---|
| JM901 | 97.20 | 1.00 | 1.80 | | | | |
| JM902 | 97.20 | 1.00 | | 1.80 | | | |
| JM903 | 97.20 | 1.00 | | | 1.80 | | |
| JM904 | 97.20 | 1.00 | | | | | 1.80 |
| JM905 | 97.20 | 1.00 | 1.50 | 0.30 | | | |
| JM906 | 97.20 | 1.50 | | | 1.30 | | |
| JM908 | 92.70 | 1.00 | 6.30 | | | | |
| JM910 | 92.70 | 1.00 | 1.00 | 3.30 | | | 2.00 |
| JM930 | 93.20 | | 1.00 | 3.50 | | | 2.30 |
| Argentium ® 932 | 93.20 | 1.00 | | | | 5.80 | |
| Argentium ® 971 | 97.20 | 1.00 | | | | 1.80 | |
| Autium ® 925* | 93.8 | | | | | 0.06 | 5.08 |

*Also includes 1.0% Pd and 0.06% Au 10 samples of each alloy were prepared in the form of specimens of diameter 15 mm. One surface of each specimen was pretreated by polishing it with emery paper grade 1000 followed by grade 2500, then with a cloth disc and a suspension of an abrasive with a particle size less than 1 μm and finally with a cloth disc and a suspension of an alumina abrasive with a particle size of less than 0.3 μm.

Specimens from each alloy were tested for resistance to tarnishing using thioacetamide as the tarnishing agent and following the procedure set down in SN EN ISO 4538 (NIHS 96-50):1978. The tests were conducted at ambient temperature and 75% relative humidity. The appearance of the specimens was observed before the test began and after 24 and 48 hours by measuring colour according to the protocol CIE 1976 L*a*b*. The light source was D65, the observations were made at 10 degrees (the rest of these parameters will need to be explained). The results were as follows.

| Sample | Observations |
|---|---|
| JM901 | Light sulphurisation of the surface observed after 24 hours becoming a bit more noticeable after 48 hours with the surface turning slightly yellowy brown |
| JM902 | Sulphurisation of the surface observed after 24 hours, the surface becoming uniformly more yellow. More marked sulphurisation observed after 48 hours with a brown surface colour and blue-ish discolouration round the circumference |
| JM903 | Sulphurisation of the surface observed after 24 hours, the surface becoming uniformly more yellow. More marked sulphurisation observed after 48 hours with a brown surface colour and blue-ish discolouration round the circumference |
| JM904 | Sulphurisation of the surface observed after 24 hours, the surface becoming uniformly more yellow. More marked sulphurisation observed after 48 hours with a brown surface colour and areas of blue-ish discolouration round the circumference |
| JM905 | Sulphurisation of the surface observed after 24 hours, the surface becoming uniformly more yellow. More marked sulphurisation observed after 48 hours with a brown surface colour |
| JM906 | Sulphurisation of the surface observed after 24 hours, the surface becoming uniformly more yellow. More marked sulphurisation observed after 48 hours with a brown surface colour |
| JM908 | Light sulphurisation of the surface observed after 24 hours. More marked sulphurisation observed after 48 hours with a brown surface colour |
| JM910 | Light sulphurisation of the surface observed after 24 hours. More marked sulphurisation observed after 48 hours with a brown surface colour and areas of blue-ish discolouration round the circumference |
| JM930 | Very light sulphurisation of the surface observed after 24 hours. More marked sulphurisation observed after 48 hours with a brown surface colour and areas of blue-ish discolouration round the circumference |
| Argentium ® 932 | Very light sulphurisation of the surface observed after 24 hours becoming a bit more noticeable after 48 hours with the surface turning browny-yellow. |
| Argentium ® 971 | Very light sulphurisation of the surface observed after 24 hours becoming a bit more noticeable after 48 hours with the surface turning browny-yellow in places. |
| Autium ® 925 | Very light sulphurisation of the surface observed after 24 hours becoming a bit more noticeable after 48 hours with the surface turning brown in places |

These results show that after 48 hours of thioacetamide treatment, the alloy according to the invention showed the best resistance to tarnishing whilst after 24 hours the performance of the alloy according to the invention was comparable with the commercially available alloys meaning that overall the best resistance to tarnishing was exhibited by the alloy according to the invention.

EXAMPLE 3

In this example, the resistance to tarnishing of two alloys according to the invention is compared with two commercially available alloys that are marketed as resistant to tarnishing. Three tests were carried out—a salt spray test according to SN EN ISO 9227:2006, an artificial sweat test according to SN EN ISO 3160-2:2003 and a tropical climate test according to 40/92 DIN 50 015:1975. One surface of each specimen was pretreated by polishing it with emery paper grade 1000 followed by grade 2500, then with a cloth disc and a suspension of an abrasive with a particle size less than 1 μm and finally with a cloth disc and a suspension of an alumina abrasive with a particle size of less than 0.3 μm.

Salt Spray Test

The conditions used were 5% NaCl vapour at 35° C. with a relative humidity of 100% for 4 days. Observations were made after 1 and 4 days. The results were as follows.

| Alloy | Observations after 1 day | Observations after 4 days |
|---|---|---|
| JM917 | No change visible | No change visible |
| JM920 | Some visible marks on the polished surface | Very slight yellowing of the polished surface |
| Argentium ® 970 | Some orange-yellow colouration on the polished surface | Little change |
| Precinox ® Ag925 | Strong yellow colour with some green streaks on the polished surface | Orange colouration on the polished surface |

These results show a superior resistance to tarnishing of the alloy JM917 according to the invention with the performance of the alloy JM920 being comparable to that of the commercially available alloy Argentium® 970.

Artificial Sweat Test

Each specimen was placed on a cotton fabric soaked I artificial sweat with the polished face down and maintained at a temperature of 40° C. in 100% relative humidity for four days. Observations were made after 1 and 4 days. The results were as follows.

| Alloy | Observations after 1 day | Observations after 4 days |
|---|---|---|
| JM917 | Formation of numerous pinholes and yellow spots on the polished surface | Black colouration over the whole of the polished face |
| JM920 | Formation of numerous pinholes with radial fissures. Visible brownish tarnish on the polished face | Black colouration over the whole of the polished face |
| Argentium ® 970 | Formation of numerous pinholes with black colouration on the polished face | Black colouration over the whole of the polished face |
| Precinox ® Ag925 | Black tarnish on the polished face | Black colouration over the whole of the polished face |

These results show that the resistance to tarnishing of the two alloys according to the invention was better than the commercially available alloy Precinox® Ag925 and only slightly less good than that of the commercially available alloy Argentium® 970.

Tropical Climate Test

The specimens were maintained at 40° C. plus/minus 0.5° C. under a relative humidity of 92% plus/minus 35 for 7 days. Observations were made after 1, 4 and 7 days. The results were as follows.

| Alloy | Observations after 1 day | Observations after 4 days | Observations after 7 days |
|---|---|---|---|
| JM917 | Formation of several circular marks on the polished face | Little visible alteration | Little visible alteration |
| JM920 | No visible alteration | No visible alteration | No visible alteration |
| Argentium ® 970 | Numerous small yellow speckles on the polished face | Little visible alteration | Deepening in colour of the speckles |
| Precinox ® Ag925 | Very slight brown colouration on parts of the polished face | Little visible alteration | Formation of several round orange marks |

These results show that both the alloys according to the invention had a superior resistance to tarnishing under these conditions that did the commercially available alloys. Overall, the results of these three tests show the alloys of the invention have a good resistance to tarnishing under a wide range of conditions.

EXAMPLE 4

In this example, the resistance to firestain of three alloys according to the invention, JM901, JM917 and JM920 was compared with that of a commercially available alloy. Prior to testing, one surface of each specimen was pretreated by polishing it with emery paper grade 1000 followed by grade 2500, then with a cloth disc and a suspension of an abrasive with a particle size less than 1 μm and finally with a cloth disc and a suspension of an alumina abrasive with a particle size of less than 0.3 μm.

The specimens were heated in an oven in an oxidising atmosphere at 580° C. for one hour. After this heat treatment, the specimens were immersed in a 10% solution of sulphuric acid at 70° C. for 4 minutes and rinsed. Then the specimens were enrobed and prepared according to the procedure set out in SN EN ISO 1463:2003 so as to determine the maximum and minimum depth of the oxidation.

In order to understand the effect of the heat treatment on these alloys, samples were weighed before and after the treatment. As detailed below, the results show an increase in the weight of the samples after the heat treatment which appears to be a function of their copper content or, to a lesser extent, their zinc content. It is hypothesised that these increases are due to formation of the respective oxides during the heat treatment which may be regarded as a measure of the likely development of firestain during brazing or soldering. The results were as follows.

| Sample | Appearance after heat treatment | Weight before heat treatment (g) | Weight after heat treatment (g) | Difference (g) |
|---|---|---|---|---|
| JM901 cast | Slight blue colouration apparent | 1.6398 | 1.6403 | 0.0005 |
| JM901 rolled | No change visible | 2.4389 | 2.4391 | 0.0002 |
| JM917 cast | No change visible | 1.9220 | 1.9222 | 0.0002 |
| JM917 rolled | No change visible | 2.5711 | 2.5712 | 0.0001 |
| JM920 cast | Slight blue colouration apparent | 1.7274 | 1.7280 | 0.0006 |
| Precinox ® Ag925 cast | Black colouration apparent | 1.7453 | 2.0543 | 0.3090 |
| Argentium ® 930 rolled | Black colouration apparent | 2.8660 | 2.8676 | 0.0016 |
| Argentium ® 970 rolled | Black colouration apparent | 1.9741 | 1.9750 | 0.0009 |
| Autium ® 925 rolled | Black colouration apparent | 2.4061 | 2.4065 | 0.0004 |

These results show a degree oxidation of the alloys according to the invention which is around two orders of magnitude less than that of the commercially available alloy.

Figure 1:
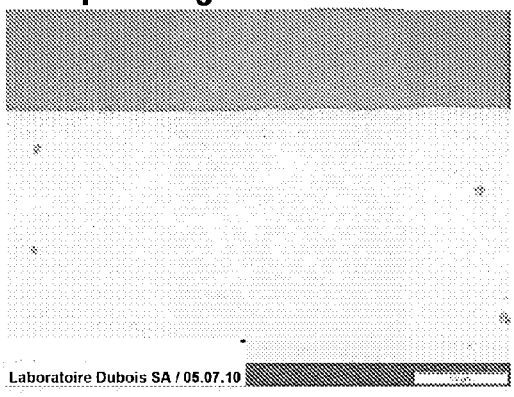
Figure 1:
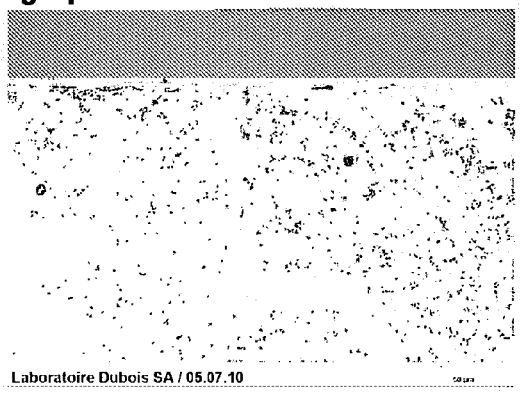
Figure 1:
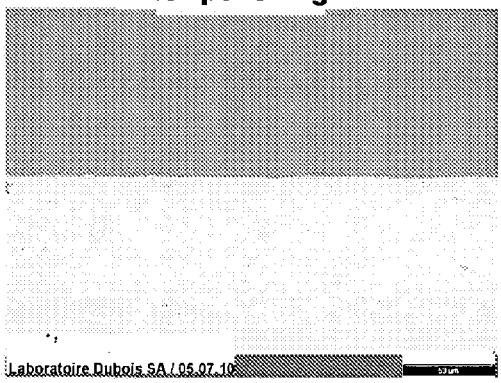
Figure 1:
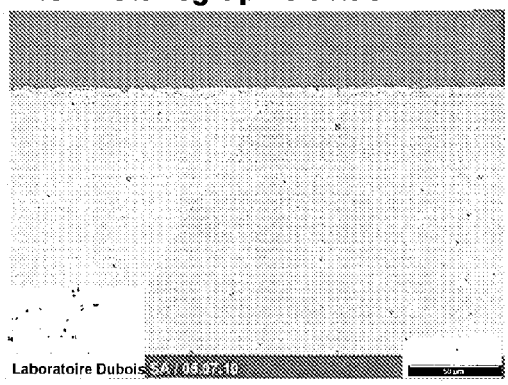
Figure 1:
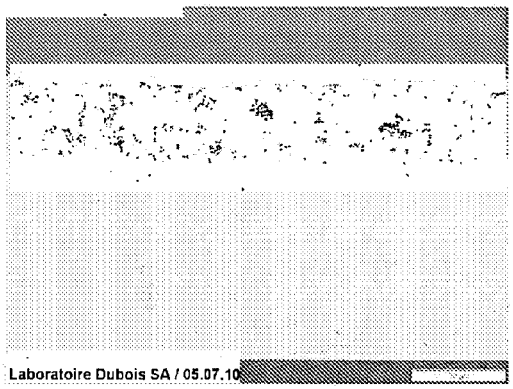
Figure 1:
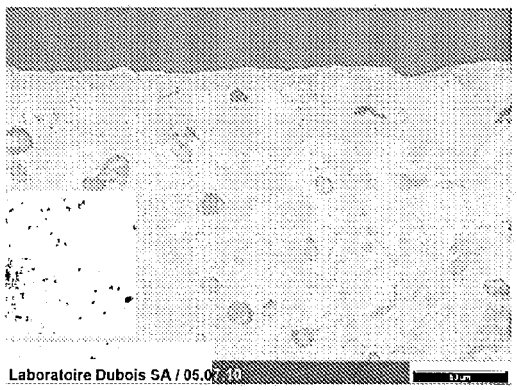

FIGS. 1 (*a*), (*b*), (*c*) and (*d*) show, respectively, the microstructure of cross-sections of specimens of cast alloys JM901, JM917, JM920 and Precinox® Ag925 before the heat treatment and after the heat treatment and metallographic attack. It may be seen that none of the alloys of the invention showed any modification of the surface after the polishing step but that the surface of the Precinox® specimen already showed a marked measure of oxidation as well as a significant change after metallographic attack. The depth of oxidation was measured at between 20.2 and 59.3 μm.

The invention claimed is:

1. A silver alloy comprising at least 95 wt % silver, from 0.70 to 1.65 wt % germanium, from 1.30 to 1.80 wt % indium, from 0.000 to 0.015 wt % boron, from 0 to 1.0 wt % palladium, and from 0 to 0.02 wt % copper.

2. The alloy according to claim 1, wherein the minimum silver content is 97.00 wt %.

3. The alloy according to claim 1, wherein the germanium content is from 0.90 to 1.50 wt %.

4. The alloy according to claim 1, wherein the boron content is from 10 to 100 ppm.

5. The alloy according to claim 1, which consists of at least 97.00 wt % silver, from 0.70 to 1.65 wt % germanium, from 1.30 to 1.80 wt % indium, from 0.000 to 0.015 wt % boron, and from 0 to 0.02 wt % copper.

6. The alloy according to claim 1, wherein the minimum silver content is 97.00 wt %.

7. The alloy according to claim 1, wherein the germanium content is from 0.90 to 1.50 wt %.

8. The alloy according to claim 1, wherein the boron content is from 10 to 100 ppm.

9. The alloy according to claim 1, which consists of at least 95.00 wt % silver, from 0.70 to 1.65 wt % germanium, from 1.30 to 1.80 wt % indium, from 0.000 to 0.015 wt % boron, from 0 to 1.0 wt % palladium, and from 0 to 0.02 wt % copper.

* * * * *